US005461551A

United States Patent [19]

Clayton

[11] Patent Number: 5,461,551

[45] Date of Patent: Oct. 24, 1995

[54] PORTABLE DARKROOM SAFELIGHT

[76] Inventor: Magill W. Clayton, 2710 N. Campbell Ave., Tucson, Ariz. 85719

[21] Appl. No.: 76,438

[22] Filed: Jun. 11, 1993

[51] Int. Cl.[6] ..... F21L 9/00; F21V 9/00

[52] U.S. Cl. ..... 362/183; 362/296; 362/293; 362/802; 362/803; 315/159; 340/321

[58] Field of Search ..... 362/183, 276, 362/287, 288, 293, 802, 803, 418; 315/134, 159, 86; 340/321, 326; 250/562

[56] References Cited

U.S. PATENT DOCUMENTS

| | | | |
|---|---|---|---|
| 3,056,332 | 10/1962 | Beregowitz | 315/159 |
| 3,080,491 | 3/1963 | Howell | 362/276 |
| 3,393,312 | 7/1968 | Dahl | 362/183 |
| 3,405,262 | 10/1968 | Dolan et al. | 362/293 |
| 3,971,929 | 7/1976 | Erdell | 362/293 |
| 4,605,993 | 8/1986 | Zelina, Jr. | 362/183 |

*Primary Examiner*—Stephen F. Husar
*Assistant Examiner*—Y. Quach
*Attorney, Agent, or Firm*—Ogram & Teplitz

[57] ABSTRACT

A portable drakroom safelight which incorporates several features which enhance its usefulness in a darkroom. The portable safelight includes a lamp, a safelight filter, rechargeable batteries, a light sensor, and control means. The safelight filter filters all light produced by the lamp, thus making the safelight safe for use in a darkroom and with photosensitive materials. A surface mounting bracket or stand supports the portable safelight and includes a transformer for converting household electric current into low voltage direct current suitable for use by the portable safelight. When the portable safelight is removed from the mounting bracket it automatically switches to operate from the rechargeable batteries and its illumination level is automatically reduced. The lamp is automatically turned off or on when the light sensor detects the presence or absence of ambient white light. Other features include a proximity detector for detecting the distance between the lamp and an object and a low battery charge detection means and/or battery timer. A pullout or adjustable stand or neck allows the portable safelight to be easily pointed in any direction or moved to different locations.

16 Claims, 3 Drawing Sheets

PORTABLE DARKROOM SAFELIGHT

BACKGROUND OF INVENTION

This invention relates generally to lamps and more specifically to safelight lamps used in darkrooms for photosensitive materials and the like.

Safelight lamps are commonly known in the art. A safelight is a lamp which emits filtered light of certain wavelengths making it safe to use in a darkroom with photosensitive and X-ray sensitive materials. The most common use of safelights is in the development of photographic negatives, X-Ray negatives, and the like.

Simple safelights are made by merely coating incandescent light bulbs with a colored filtering coating such as amber or red. Florescent light bulbs are also used as safelights by putting a filtering coating on the florescent light bulb. These coated bulbs are screwed or mounted into conventional light fixtures to create simple safelights.

These simple safelights operate the same as conventional lamps and have no special features directed to the unique requirements of working in a darkroom.

A second type of safelight is specifically designed for use in darkrooms. These safelights use a low wattage bulb, typically 7 to 15 watts, located inside a lamp housing. A safelight filter is mounted over the lamp opening in the housing and filters the light produced by the bulb making the device safe for use with photosensitive materials.

These safelights are specifically designed for use in darkrooms, however, the only advantage of these safelights is their ability to interchange different safelight filters. They have no other special features directed to the unique requirements of working in a darkroom.

Even these so called "safelights" are not completely safe to use when working with photosensitive and X-ray sensitive materials. Several additional safeguards typically must be taken to ensure light from the safelight does not damage or fog the photosensitive materials.

First, safelights must use very low wattage bulbs to reduce damage or fogging to photosensitive materials. Typically, safelights use only 7 to 15 watt bulbs. Second, safelights are normally kept at least four feet from the photosensitive materials to further reduce fogging. Third, for some materials, safelights can be used for only a brief period of time to limit fogging of the photosensitive film or material.

Because of these special requirements and other limitations, operating in a darkroom is often very inconvenient. The dim filtered light from the safelight barely illuminates the work area and does not illuminate other areas of the darkroom, i.e. in corners, under counters, on the floor, etc. If something is dropped or misplaced, it is difficult to find without turning on a white light and destroying the photosensitive materials.

Clearly, there exists a need for a new safelight which provides illumination in all locations of a darkroom, warns about over exposure to the safelight, and simplifies the operation of a typical darkroom.

SUMMARY OF THE INVENTION

The invention creates a portable darkroom safelight which incorporates several features which enhance its usefulness in a darkroom. The portable safelight includes a lamp, a safelight filter, rechargeable batteries, a light sensor, and control means.

The safelight filter filters all light produced by the lamp, thus making the safelight safe for use in a darkroom and with photosensitive and X-ray sensitive materials.

A surface mounting bracket or stand supports the portable safelight and includes a transformer for converting household electric current into low voltage direct current suitable for use by the portable safelight. When the portable safelight is removed from the mounting bracket it automatically switches to operate using rechargeable batteries and its illumination level is automatically reduced.

In the preferred embodiment, the lamp is automatically turned off or on when the light sensor detects the presence or absence of ambient white light. This feature permits the safelight to operate whenever the room is intended to be "dark"; but, is inoperative during the "lighted" portion of the task.

Other embodiments include a proximity detector for detecting the distance between the lamp and an object and a low battery charge detection means and/or battery timer. A pullout or adjustable stand or neck allows the portable safelight to be easily pointed in any direction or moved to different locations.

A feature of the invention is its portability. Rechargeable batteries allow the invention to be operated without the need for electric cords. This is particularly useful when illumination is needed in remote locations of a darkroom, such as when something is dropped on the floor, under a counter, or when something must be found in a drawer, etc. This feature also allows the portable safelight to be recharged outside of a darkroom which does not have an electric outlet and then carried into and used in the darkroom.

The portable safelight is normally supported by a wall or surface mounting bracket. The mounting bracket supports the safelight in a position to provide darkroom illumination for most applications. The mounting bracket includes a transformer which supplies electric power to the lamp for operating the lamp and recharging the batteries. In the preferred embodiment, the mounting bracket has a transformer for transforming household electric current into low voltage direct current for use by the portable safelight.

When the portable safelight is removed from the mounting bracket, the control circuitry automatically switches the safelight to operate from battery power, thereby eliminating any period of darkness.

Another feature of the invention is the white light sensor. A photodiode or the like is mounted on the portable safelight to detect the presence or absence of ambient white light. When ambient white light is detected, the safelight lamp is turned off. When no ambient white light is detected, the safelight lamp is activated. The white light sensor eliminates the need for continually turning the safelight lamp off and on when using the darkroom many times a day.

Yet another feature of the invention is the proximity sensor and alarm. A proximity sensor is mounted near the safelight lamp and is directed in the same direction as the safelight illumination. The alarm is activated when an object is detected within a predetermined distance in direct line with the safelight lamp. In the preferred embodiment, the proximity alarm is activated when an object is within two feet of the safelight lamp.

Proximity detectors are well known in the art. The preferred embodiment uses a proximity sensor utilizing sound waves or light waves. This feature alerts the user anytime the safelight is too close to an object, and therefore, in danger of damaging photosensitive materials.

Yet another feature of the invention is related to the rechargeable batteries in the safelight. Circuitry is included to detect low voltage or low charge conditions on the rechargeable battery. In addition to the low battery circuitry, there is also included a battery timer. The battery timer measures the amount of time the safelight operates on power from the rechargeable battery. When a predetermined amount of time has passed, the alarm signals the user, thus preventing complete battery discharge and safelight failure.

The final features of the invention are the adjustable mounting bracket and the flexible neck. In one embodiment, the mounting bracket includes an extendable and retractable capability which allows the safelight to be moved to many different positions. Included in this feature is the ability to rotate the safelight at the end the extendable mounting bracket. A similar feature is the adjustable neck connecting the lamp portion and the body of the safelight. This allows the lamp portion of the safelight to be moved and rotated to different positions.

The significant features of the invention are illustrated in the figures and described more fully below.

DETAILED DESCRIPTION OF THE DRAWINGS

Figure 1:
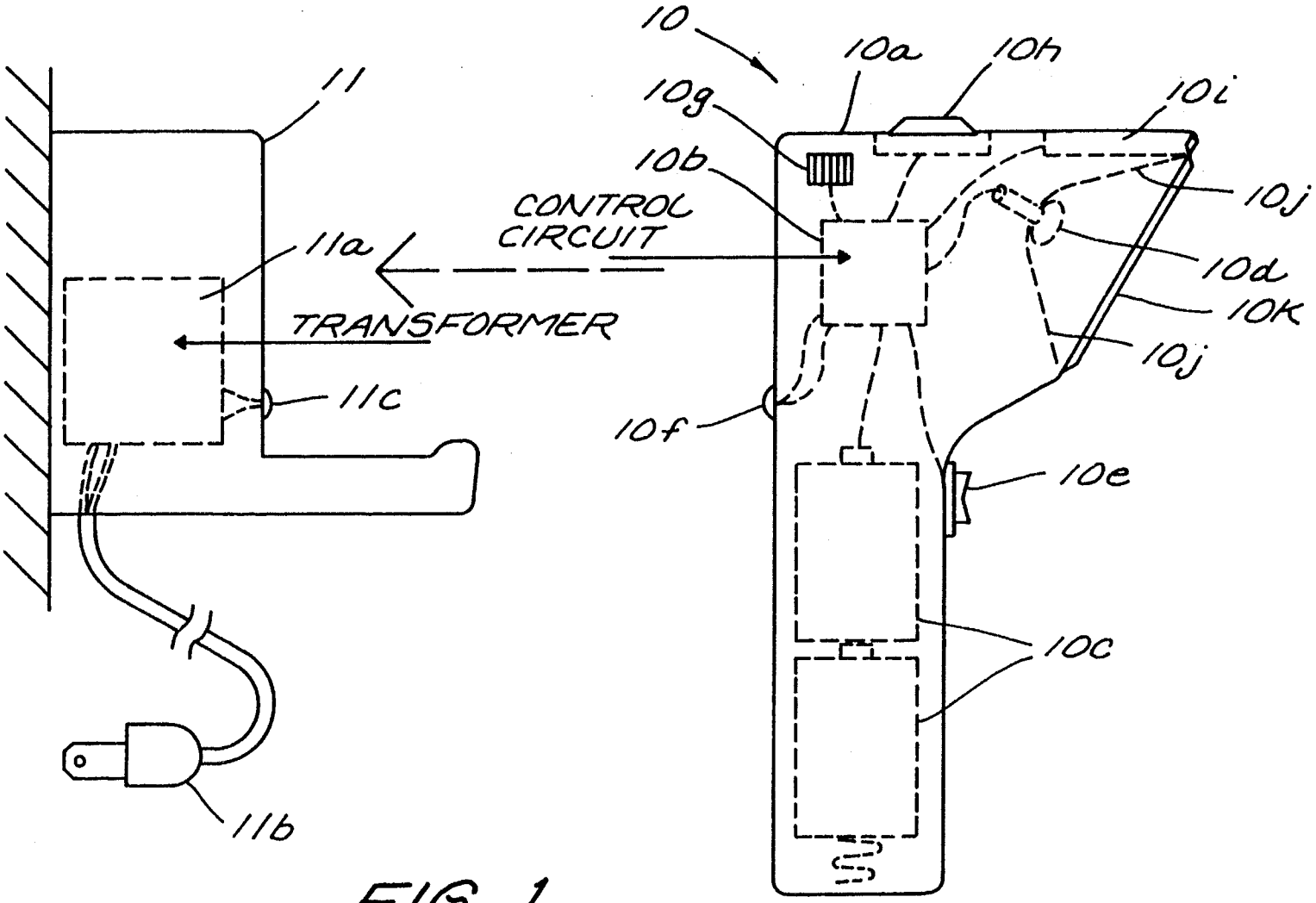
FIG. 1 is a profile view of the invention showing the portable safelight and the mounting bracket.

FIG. 1 is a profile view of the invention showing the portable safelight and mounting bracket.

Portable safelight 10 is shown detached from mounting bracket 11. Control circuit 10*b* is mounted inside housing 10*a*. Control circuit 10*b* is in communication with batteries 10*c*, bulb 10*d*, on/off switch 10*e*, electric connectors 10*f*, alarm 10*g*, light sensor 10*h*, and proximity sensor 10*i*. Reflector 10*j* and filter 10*k* complete the principal components of portable safelight 10.

Control circuit 10*b* includes all the necessary circuitry for controlling the operation and functions of portable safelight 10. The specific electrical design of control circuit 10*b* is comprised of electronic circuits that are well known in the art.

Control circuit 10*b* is connected to electric connectors 10*f*. During normal operation, when portable safelight is mounted on mounting bracket 11, electric connectors 10*f* convey electric power from mounting bracket 11. If on/off switch 10*e* is "ON", then control circuit 10*b* directs electric current to bulb 10*d* thereby causing illumination.

Control circuit 10*b* also directs the necessary electric power to light sensor 10*h*. If light sensor 10*h* detects the presence of ambient white light, ie. normal room illumination, then light sensor 10*h* generates a light-signal to communicate the presence of white light to control circuit 10*b* which then turns off electric current to bulb 10*d*.

In the preferred embodiment, the rechargeable safelight further includes a light sensing apparatus 10*h* in communication with said controller 10*b*. Controller 10*b* generates a light-signal indicative of the presence of white light. This light-signal is used for the determination of activating lamp 10*d*.

Light sensors are well known in the art. The preferred embodiment uses a photodiode to detect the presence of ambient white light. The operation of photodiodes as light detectors are well known in the art.

Control circuit 10*b* also includes battery charging circuitry to assist in charging batteries 10*c*. Batteries are charged when portable safelight 10 is mounted in mounting bracket 11. Battery charging circuits are well known in the art.

Control circuit 10*b* further includes low battery detection circuitry for detecting a low charge condition for batteries 10*c*. When batteries 10*c* discharge to a predetermined low level, control circuit 10*b* generates a charge warning signal and notifies the operator via alarm 10*g*. The preferred embodiment uses a low power audible alarm. Low battery detection circuits are well known in the art.

Another element of control circuit 10*b* is the timer operation. The timer measures the length of time that safelight 10 operates on power from batteries 10*c*. When safelight 10 has been powered by batteries 10*c* for a predetermined length of time, the user is notified via alarm 10*g*. Timer circuits are well known in the art.

The preferred embodiment also includes a proximity warning feature. This feature warns the operator that the safelight may be too close to photosensitive materials. Proximity sensor 10*i* detects the presence of objects which are in a direct line with light from portable safelight 10. Proximity sensor 10*i* generates a proximity signal which is communicated to control circuit 10*b*. When objects are detected within a predetermined distance from portable safelight 10, the operator is notified via alarm 10*g*.

In the preferred embodiment, the proximity sensor 10*i* is only activated when portable safelight 10 is removed from mounting bracket 11, since this is when portable safelight 10 is most likely to be brought within close proximity to photosensitive materials. The proximity warning is preferably set to warn the operator when an object is closer than two feet to the portable safelight 10.

The safelight filter 10*k* covers the entire opening in which bulb 10*d* is positioned. Safelight filter 10*k* filters all the light produced by bulb 10*d*, filtering out wavelengths of light which are harmful to the photosensitive materials. A wide variety of safelight filters are commercially available. One commercial source of safelight filters is the Eastman Kodak Company of Rochester, N.Y.

Reflector 10*j* reflects light produced from bulb 10*d*.

Mounting bracket 11 supports portable safelight 10 and attaches to a surface, preferably a wall. A secondary function of mounting bracket 11 is to provide electric power, via transformer 11A and connection 11C to portable safelight 10. The preferred embodiment uses a transformer 11*a* to convert conventional household electric current into low voltage direct current suitable for use by portable safelight 10. In the preferred embodiment, transformer 11*a* is located inside mounting bracket 11. Electric plug 11*b* plugs into a conventional electric outlet and conveys electric power to transformer 11*a*. An alternate embodiment is envisioned where transformer 11*a* is external to mounting bracket 11 and plugs directly into an electrical outlet. Transformer 11*a* converts the electric power to low voltage direct current. The electric power is conveyed to portable safelight 10 via mounting bracket electric connectors 11*c* and portable safelight electric connectors 10*f*. Many alternate embodiment of mounting bracket 11 are envisioned including the wide variety of mounting bracket designs commonly known in the art.

Figure 2B:
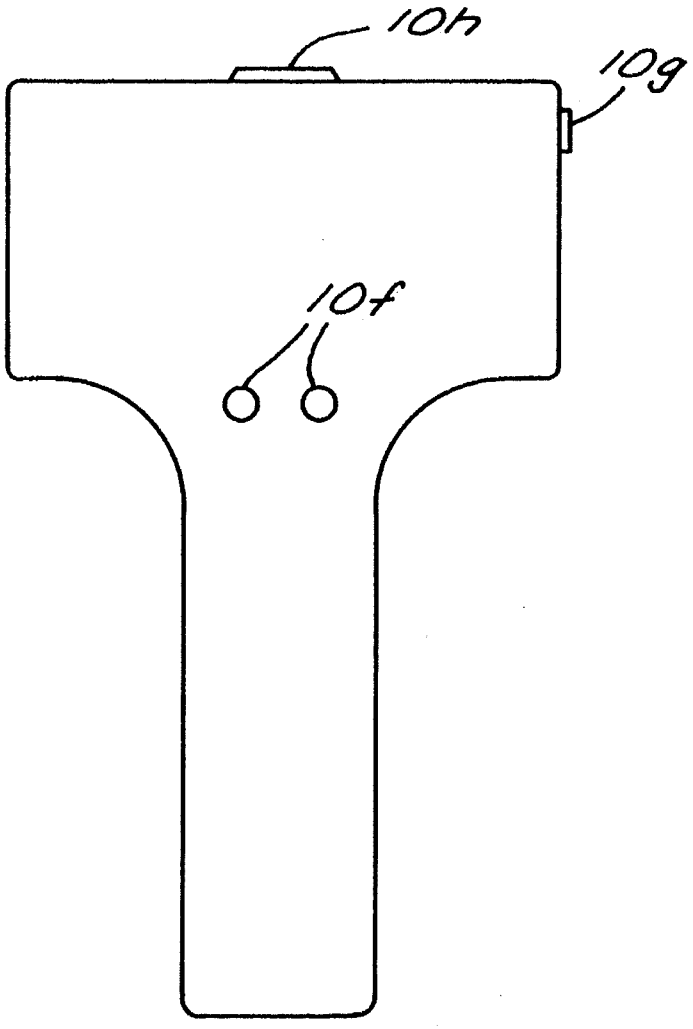
FIG. 2*b* shows a rear view of the safelight.
Figure 2A:
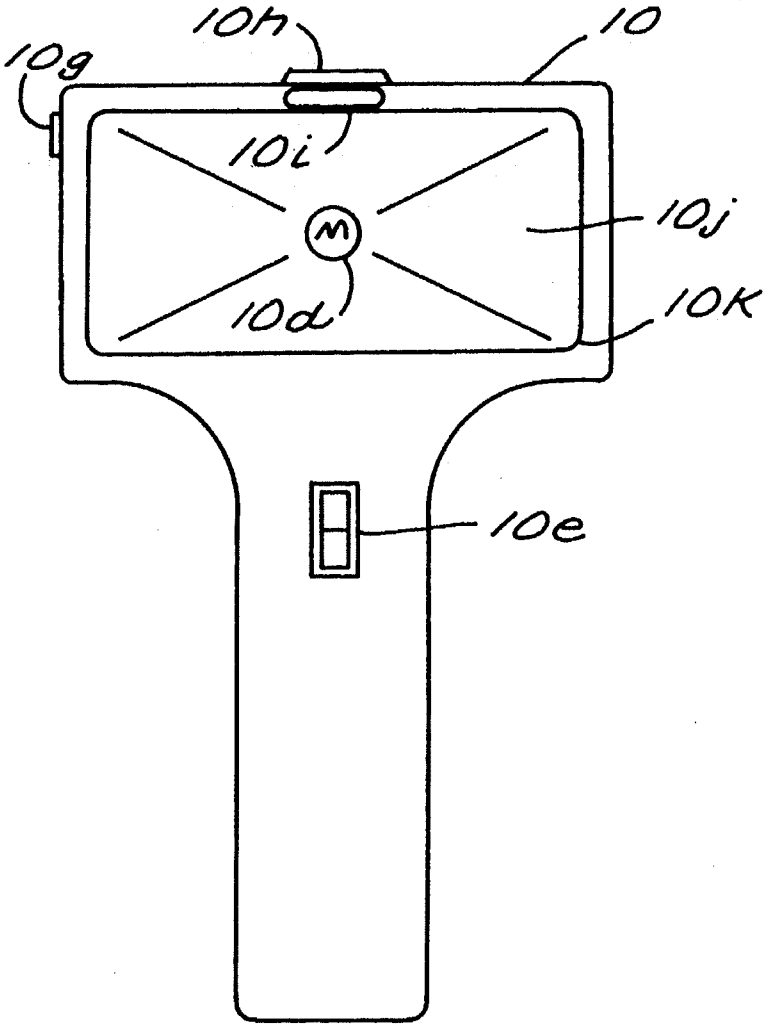
FIG. 2*a* shows a front view of the safelight.

FIGS. 2*a* and 2*b* show the front view and rear view, respectively, of the preferred embodiment of the portable safelight.

On/off switch 10*e* is mounted on the front of portable safelight 10. Bulb 10*d* is mounted recessed in portable safelight 10. Bulb 10*d* is partially surrounded by reflector 10*j*. Safelight filter 10*k* completely covers the opening containing bulb 10*d* and reflector 10*j*. Light sensor 10*h* is mounted on top of portable safelight 10. Proximity sensor 10*i* is mounted above the opening containing bulb 10*d* and reflector 10*j*. Proximity sensor 10*i* points in the same direction as the center of illumination from safelight 10. Electric connectors 10*f* are positioned on the back of portable safelight 10.

Figures 3, 4:
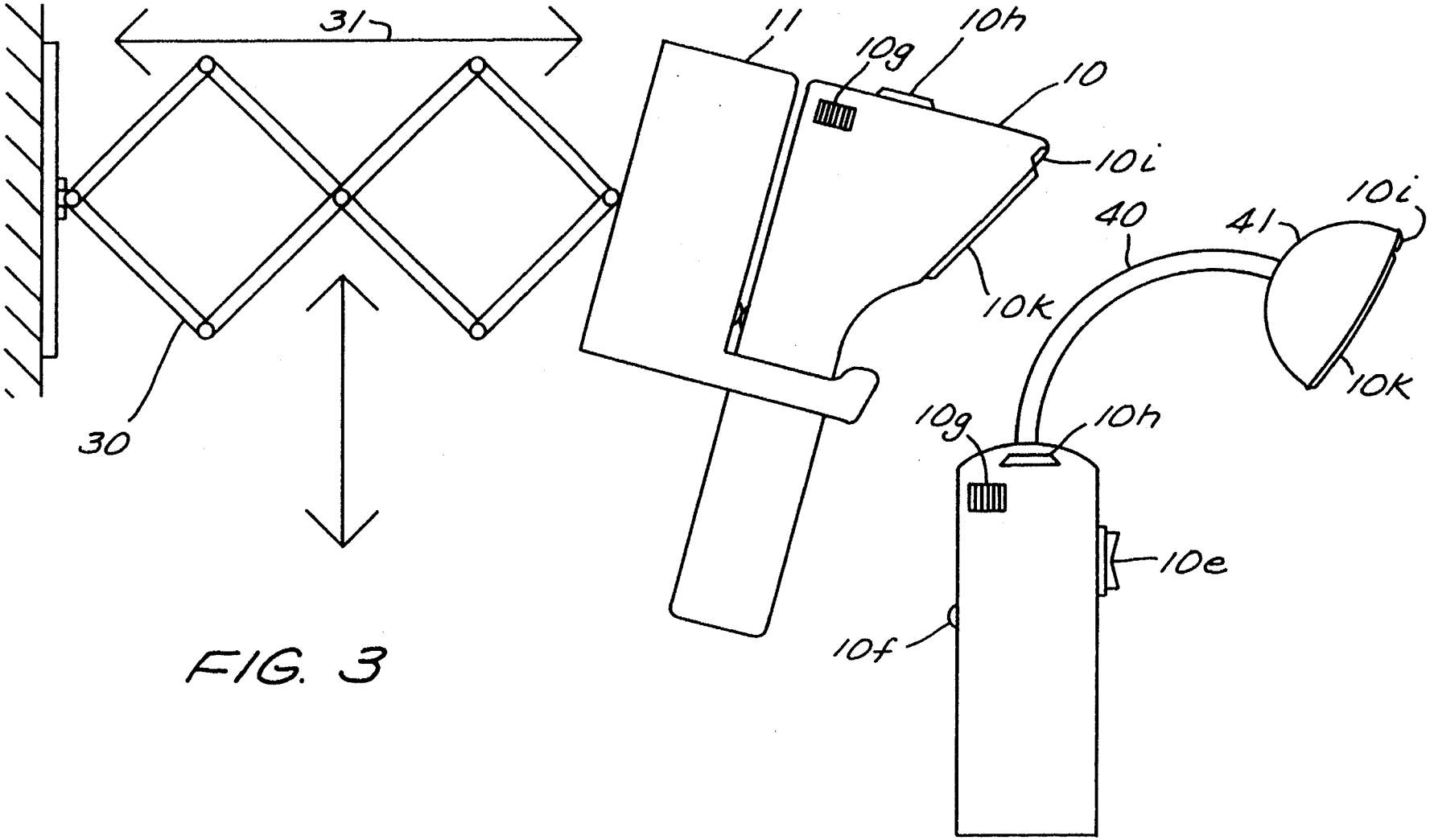
FIG. 3 shows the extending armature of the mounting bracket.
FIG. 4 shows an alternate embodiment of the safelight having a flexible armature between the lamp and the housing of the safelight.

FIG. 3 shows the extending armature of the base.

A drawback of the prior art is the inability to move the safelight to different positions and to point the safelight in different directions. The adjustable armature 30 permits the mounting bracket 11 and portable safelight 10 to be moved to different positions as needed by an operator.

The preferred embodiment uses a conventional scissor like armature as shown in FIG. 3. Adjustable armature 30 permits a wide range of vertical and horizontal movement so that the portable safelight 10 can be positioned as desired. Adjustable armature 30 is also extendable and retractable as shown by arrow 31.

Alternate embodiments of adjustable armature 30 are envisioned and include the wide range of adjustable stands and armatures that are well known in the art. These include, but are not limited to, telescoping tubes, pull out shelves, flexible conduit/tubing, and the like.

FIG. 4 shows an alternate embodiment of the portable safelight. This embodiment has an adjustable or flexible neck connecting the lamp portion and the housing of the portable safelight.

Flexible neck 40 permits lamp portion 41 to be moved and adjusted as required by the operator. Lamp portion 41 includes bulb (not shown), reflector (not shown), safelight filter 10*k*, and proximity sensor 10*i*. This embodiment of the invention includes the same features as the preferred embodiment, including on/off switch 10*e*, light sensor 10*h*, alarm 10*g*, electrical connectors 10*f*, control circuit (not shown), batteries (not shown), and wall bracket (not shown).

Those of ordinary skill in the art readily see many alternate embodiments of the disclosed invention which perform substantially the same function or work, in substantially the same way, to obtain substantially the same overall result and would therefore infringe on the disclosed invention.

It is clear from the foregoing that the present invention represents a new and useful safelight for improving the efficiency, safety, and convenience of working in a darkroom.

What is claimed is:

1. A rechargeable safelight comprising:

a) a housing;

b) at least one rechargeable battery inside said housing;

c) a lamp means attached to said housing for generating visible light;

d) a filter attached to said housing for making light from said lamp means safe for photosensitive materials;

e) electrical connector means mounted on said housing for connecting to an external power source;

f) distance measuring means, mounted to said housing, for generating a proximity-signal indicative of the distance between said lamp means and an object in line with said lamp means;

g) alarm means for generating an alarm; and, f) control means inside said housing and connected to said electrical connector means for charging said at least one rechargeable battery and for controlling electric power to said lamp means and connected to said distance measuring means and said alarm means for causing said alarm means to generate an alarm in response to said proximity-signal.

2. The rechargeable safelight according to claim 1 further comprising wall mounting means for attaching said rechargeable safelight to a surface and including means for supplying electric power to said electrical connector means.

3. The rechargeable safelight according to claim 2 further comprising light sensor means attached to said housing and in communication with said control means for generating a light-signal indicative of the presence of white light.

4. The rechargeable safelight according to claim 3 wherein said control means has means for automatically deactivating said lamp means in response to said light-signal.

5. The rechargeable safelight according to claim 1 wherein said control means further includes charge warning means for generating a charge-warning-signal indicative of when said rechargeable safelight has been powered by said at least one rechargeable battery for a predetermined period of time, said charge warning means in communication with said alarm means.

6. The rechargeable safelight according to claim 5 wherein said charge warning means includes means for detecting a low electric charge on said at least one rechargeable battery and generating said charge-warning-signal in response thereto.

7. The rechargeable safelight according to claim 6 further comprising a flexible armature, said flexible armature having:

a) a first end attached to said housing; and, b) a second end attached to said lamp means.

8. A portable safelight comprising:

a) a housing;

b) a lamp means attached to said housing for generating light;

c) an energy storage means inside said housing for supplying electric power to said lamp means; and, d) a filter means attached to said housing for filtering light produced by said lamp means, said filter means being of a type suitable for safe use with photosensitive materials; and, e) distance measuring means, mounted in said housing, for generating a proximity-signal indicative of a distance between said lamp means and an object in line with said lamp means; and, f) alarm means in communication with said distance measuring means for generating an audible alarm when said lamp means is less than a predetermined distance from said object.

9. The portable safelight according to claim 8 further comprising an electrical connector means attached to said housing for connecting said energy storage means to an external power source.

10. The portable safelight according to claim 9 further comprising a control means inside said housing for recharging said energy storage means using electric power from said external source and communicated via said electrical connector means.

11. The portable safelight according to claim 10 further comprising surface mounting means for removably attaching said housing to a surface and including means for supplying electric power to said electrical connector means.

12. The portable safelight according to claim 11 further comprising light sensor means for generating a light-signal indicative of the presence of white light, said light-sensor means in communication with said control means and wherein said control means has means for deactivating said lamp means in response to said light-signal.

13. The portable safelight according to claim 8 further comprising charge warning means of a control means inside said housing for generating a charge-warning-signal indicative of said lamp means being powered by said energy storage means for a predetermined period of time.

14. The portable safelight according to claim 13 wherein said charge warning means includes means for detecting a low electric charge condition of said energy storage means and wherein said charge warning means generates said charge-warning-signal in response thereto.

15. The portable safelight according to claim 14 further comprising an adjustable armature, said adjustable armature having:

a) a first end attached to said housing; and, b) a second end attached to said lamp means.

16. A darkroom safelight comprising:

a) a housing;

b) a lamp means, located in said housing, for generating visible light;

c) a flexible armature attached to said housing, said flexible armature having:

a) a first end attached to said housing, and, b) a second end attached to said lamp means;

d) a filter means attached to said housing for making light from said lamp means safe for photosensitive materials;

e) an energy storage means inside said housing for supplying electric energy to said lamp means;

f) an electrical connector means mounted on said housing for connecting to an external power source;

g) a light sensor means, attached to said housing, for generating a light-signal when ambient white light is not detected;

h) a distance sensing means, attached to said housing, for generating a proximity-signal indicative of a distance between said lamp means and an object in line with said lamp means;

i) a wall mounting means attached to a surface for removably mounting said housing to said surface and including means for supplying electric power to said electrical connector means;

j) alarm means, attached to said housing, for alerting a user to various conditions; and, k) a control means, mounted to said housing, for controlling said darkroom safelight, said control means having means for, 1) activating said lamp means using electric power from said external power supply communicated via said electrical connector means for using electric power from said energy storage means, 2) recharging said energy storage means using electric power from said external power supply communicated via said electrical connector means, 3) deactivating said lamp means in response to said light-signal, 4) activating said alarm means in response to said proximity-signal, 5) activating said alarm means in response to a predetermined amount of electric charge remaining in said energy storage means, and, 6) reducing the electric power to said lamp means when said housing is removed from said wall mounting means.

* * * * *